US006964306B2

(12) United States Patent
Bunney

(10) Patent No.: US 6,964,306 B2
(45) Date of Patent: Nov. 15, 2005

(54) MANIFOLD DEVICE AND METHOD OF USE FOR ACCESSING A CASING ANNULUS OF A WELL

(76) Inventor: Larry Bunney, 8127-78th Avenue, Edmonton, Alberta (CA) T6C 0N3

( * ) Notice: Subject to any disclaimer, the term of this patent is extended or adjusted under 35 U.S.C. 154(b) by 167 days.

(21) Appl. No.: 10/417,223

(22) Filed: Apr. 17, 2003

(65) Prior Publication Data

US 2004/0206507 A1 Oct. 21, 2004

(30) Foreign Application Priority Data

Mar. 28, 2003 (CA) ..... 2423645

(51) Int. Cl.[7] ..... E21B 33/047; E21B 17/18

(52) U.S. Cl. ..... 166/382; 166/89.2; 166/97.5; 166/368; 166/242.3

(58) Field of Search ..... 166/378, 379, 166/382, 75.1, 368, 97.5, 93.1, 75.13, 75.14, 166/242.3, 89.1, 89.2

(56) References Cited

U.S. PATENT DOCUMENTS

| | | | | |
|---|---|---|---|---|
| 3,151,680 | A * | 10/1964 | Parkhurst et al. | 166/89.1 |
| 3,354,961 | A * | 11/1967 | Pennington | 166/66.5 |
| 3,357,491 | A * | 12/1967 | Jones et al. | 166/97.5 |
| 3,414,056 | A * | 12/1968 | Brown et al. | 166/135 |
| 4,169,504 | A * | 10/1979 | Scott | 166/90.1 |
| 4,972,904 | A * | 11/1990 | Godare | 166/90.1 |
| 5,012,865 | A * | 5/1991 | McLeod | 166/90.1 |
| 5,775,420 | A * | 7/1998 | Mitchell et al. | 166/85.4 |
| 5,794,693 | A * | 8/1998 | Wright et al. | 166/85.5 |
| 5,865,249 | A | 2/1999 | Gipson et al. | |
| 6,142,232 | A | 11/2000 | Troutt et al. | |
| 6,305,475 | B1 * | 10/2001 | Carnahan | 166/313 |
| 6,315,046 | B1 | 11/2001 | Jack et al. | |
| 6,364,024 | B1 * | 4/2002 | Dallas | 166/379 |
| 6,484,807 | B2 | 11/2002 | Allen | |
| 6,626,245 | B1 * | 9/2003 | Dallas | 166/379 |
| 2003/0010498 | A1 * | 1/2003 | Tolman et al. | 166/305.1 |
| 2003/0116326 | A1 * | 6/2003 | Dallas | 166/382 |

FOREIGN PATENT DOCUMENTS

| | | |
|---|---|---|
| CA | 2228203 | 10/1998 |
| CA | 2268223 | 2/2000 |

* cited by examiner

*Primary Examiner*—Jennifer H Gay
(74) *Attorney, Agent, or Firm*—Ryan W. Dupuis; Adrian D. Battison; Michael R. Williams

(57) ABSTRACT

A manifold device connects in series between the wellhead and the outer casing of a well for providing access to the outer casing of the well without removing the wellhead. The device includes a tubular body for receiving the tubing string of the well therethrough. Plural access passages are formed in the tubular body to extend generally in the longitudinal direction of the body between an external end which is spaced radially from the hollow interior of the tubular body and an internal end converging in communication with the hollow interior at the bottom end of the manifold device. Well servicing tools can be inserted into the casing annulus defined between the outer casing and the tubing string of the well through one of the access passages formed in the tubular body of the manifold device.

20 Claims, 3 Drawing Sheets

MANIFOLD DEVICE AND METHOD OF USE FOR ACCESSING A CASING ANNULUS OF A WELL

FIELD OF THE INVENTION

The present invention relates to a manifold device for connection between an outer casing and wellhead of a well to permit access to a casing annulus defined between the outer casing and tubing string of the well, and more particularly the invention relates to method of accessing the casing annulus using the manifold device.

BACKGROUND

It is generally known that access to the well casing annulus defined between the tubing string and outer casing of a well, without removing the installed equipment which is used for production may be desirable on occasion. This access would greatly reduce the cost of servicing a well when the well bore has plugged off as a result of sand, wax or other accumulations and build ups in the well bore as the production string need not be removed. Such access also permits measuring devices to be injected into the casing annulus without the need for the same costly equipment to open the wellhead.

U.S. Pat. No. 6,315,046 and the corresponding Canadian patent 2,268,223 both to Jack et al each disclose a method of servicing a well in which a casing spool is provided for connection to the outer casing of the well which incorporates access passages into the central flow area. In order to make use of the access ports a costly installation is required in which costly wellhead equipment is made to be redundant with the installation of the new components disclosed by Jack et al. In addition by providing access passages formed integrally with a casing spool, the configuration of the casing spool access ports is such that damage may be incurred as the endless tubing is fed into the feed passages.

Other patents related to servicing of a well include U.S. Pat. No. 6,142,232 to Troutt et al, U.S. Pat. No. 6,484,807 to Allen and U.S. Pat. No. 5,865,249 to Gipson et al and Canadian patent application number 2,228,203 also to Gipson et al. In each instance the wellhead must be specially configured and/or removed to permit servicing access to the well. Such reconfiguration of the wellhead is costly as special equipment must be used to remove the existing production equipment and a endless tubing unit must also be used.

SUMMARY

According to one aspect of the present invention there is provided a manifold device for a well having an outer casing, a wellhead for being supported on the outer casing and a production tubing string for being suspended from the wellhead within the outer casing, the device comprising:

a tubular body having a hollow interior extending in a longitudinal direction of the body between first and second open ends of the body for receiving the tubing string therethrough;

at least one access passage formed in the tubular body, said access passage extending generally in the longitudinal direction of the body between an external end of said access passage which is spaced radially from the hollow interior of the tubular body and an internal end of said access passage converging in communication with the hollow interior; and mounts at the respective first and second open ends of the body for mounting the body in communication between the outer casing and the wellhead of the well.

According to a second aspect of the present invention there is provided a method of accessing a casing annulus of a well having an outer casing, a wellhead for being supported on the outer casing and a production tubing string for being suspended from the wellhead within the outer casing to define the casing annulus between the outer casing and the tubing string, the method comprising:

providing a manifold device including a tubular body having a hollow interior extending in a longitudinal direction of the body between first and second open ends of the body;

providing at least one access passage formed in the tubular body to extend generally in the longitudinal direction of the body between an external end of said access passage which is spaced radially from the hollow interior of the tubular body and an internal end of said access passage converging in communication with the hollow interior;

mounting the manifold device in communication between the outer casing and the wellhead of the well with the tubing string being received through the hollow interior of the body of the device; and inserting tools into the casing annulus through said at least one access passage formed in the tubular body of the manifold device.

The configuration in which the tubular body of the manifold device is provided with open ends for communication in series with the casing of a well and in which the ends of the device are provided with mounts for connection to existing equipment of a well permit a considerable savings of cost as minimal existing equipment is required to be replaced. Providing a tubular body in which the tubing string is permitted to be received therethrough permits the manifold device to be connected in series with the outer casing of a well regardless of the type of existing equipment of the well to permit a broad range of applications of the manifold device regardless of varying configurations of existing equipment.

The mounts at the respective first and second ends of the body are preferably configured for mounting in series with the outer casing of the well.

The hollow interior may comprise a cylindrical bore having a constant inner diameter which is approximately equal to an inner diameter of the outer casing and the wellhead equipment.

When the hollow interior of the body comprises a cylindrical bore extending through the body, the mounts preferably each comprise a counter bore terminating at an internal shoulder formed in the bore extending through the tubular body. At least one of the counter bores is preferably internally threaded.

The access passages preferably extends at an inclination of less than fifteen degrees from the longitudinal direction of the body.

The internal end of the access passages preferably lie flush with an interior surface of the hollow interior of the tubular body.

In the preferred embodiment there is provided four access passages evenly spaced circumferentially about the tubular body.

There may be provided a transitional casing between the manifold device and the wellhead so as to mount the manifold device in series with the outer casing and the transitional casing.

When the hollow interior of the tubular body is formed by a bore extending through the tubular body including a counter bore formed in at least one end of the bore which terminates at an internal shoulder, the method preferably includes receiving the outer casing in the counter bore at a bottom end of the tubular body.

The manifold device is preferably threadably secured to at least one of the outer casing and the wellhead.

BRIEF DESCRIPTION OF THE DRAWINGS

In the accompanying drawings, which illustrate an exemplary embodiment of the present invention.

DETAILED DESCRIPTION

Figure 1:
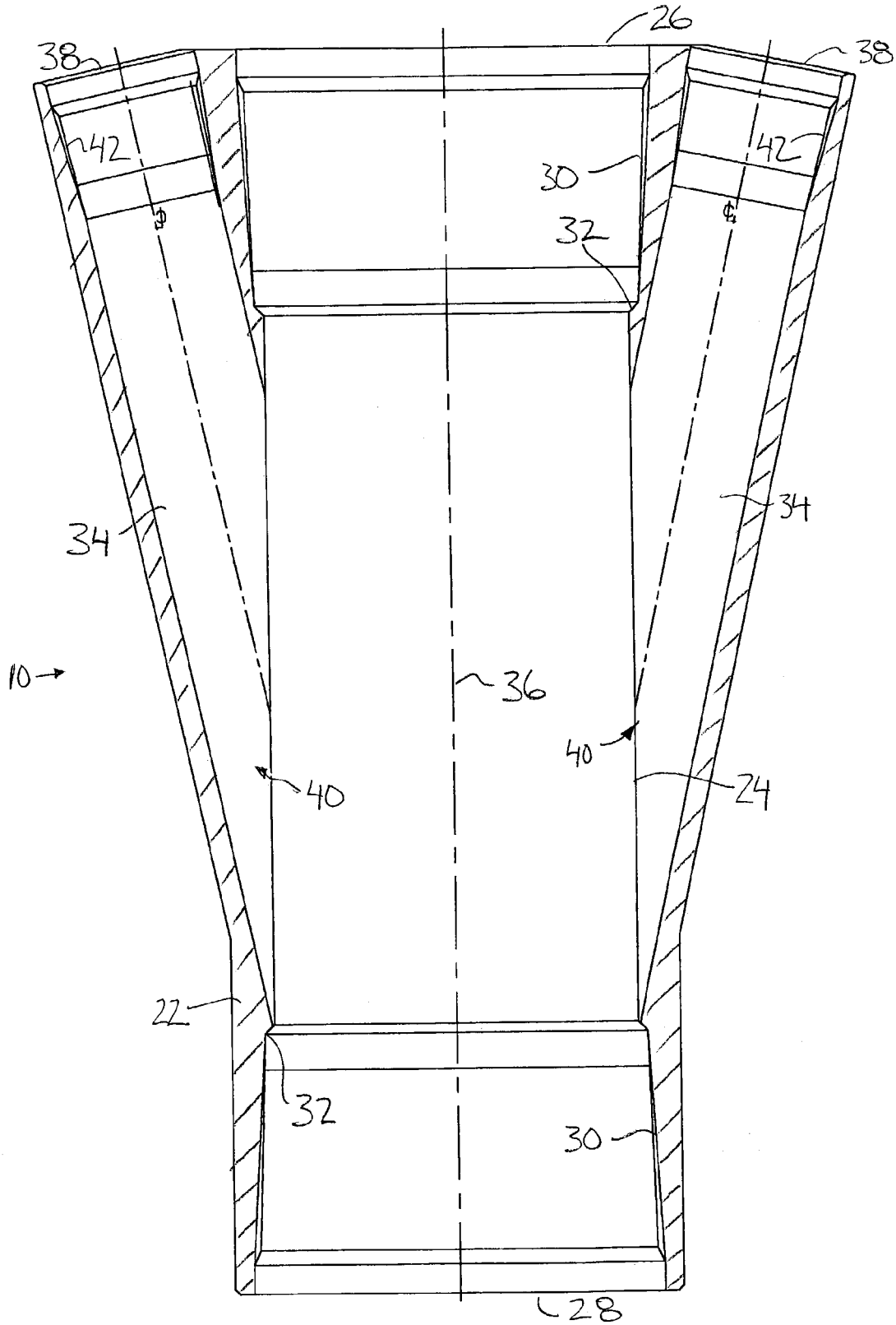
FIG. 1 is a partly sectional side elevational view of the manifold device.
Figure 2:
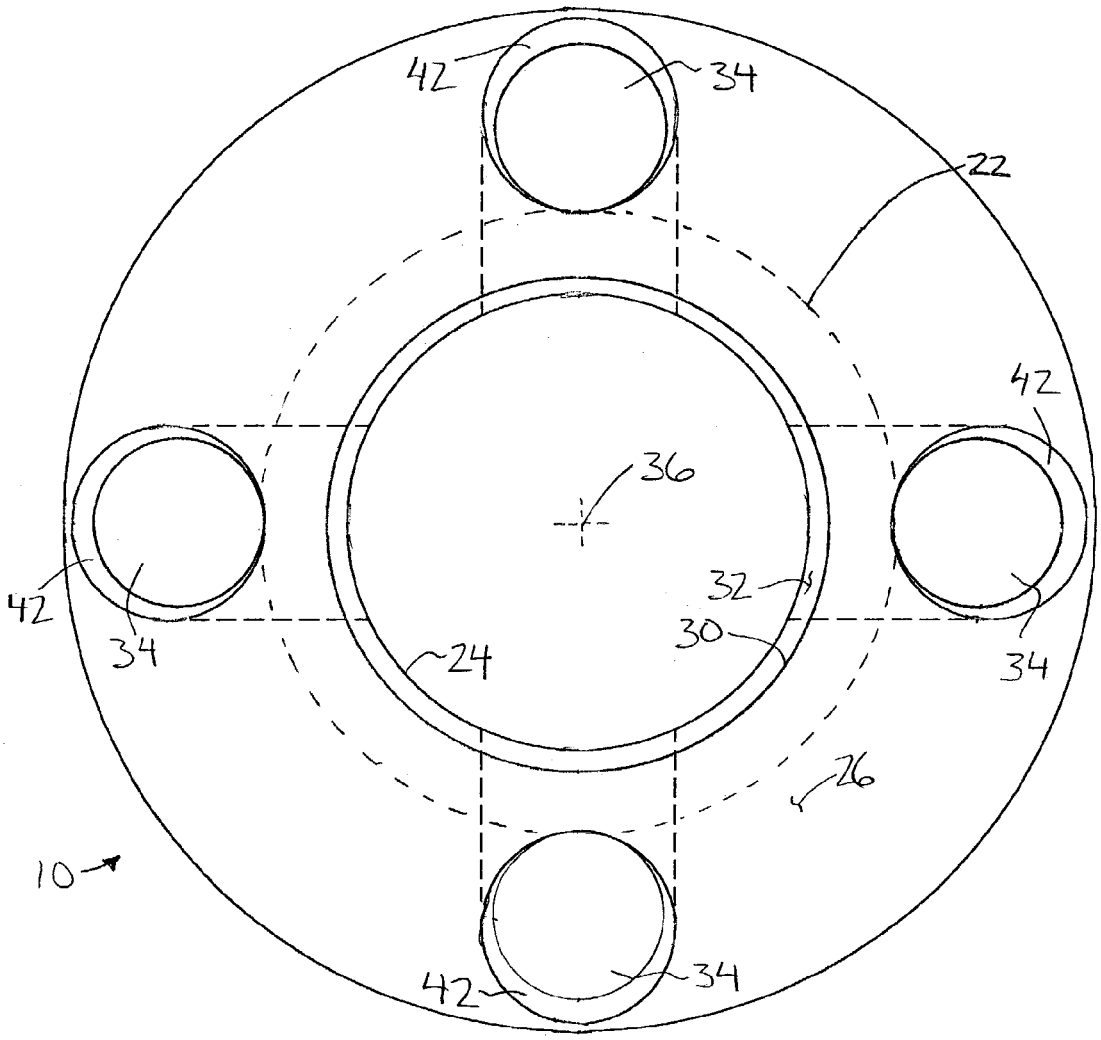
FIG. 2 is a top plan view of the manifold device.
Figure 3:
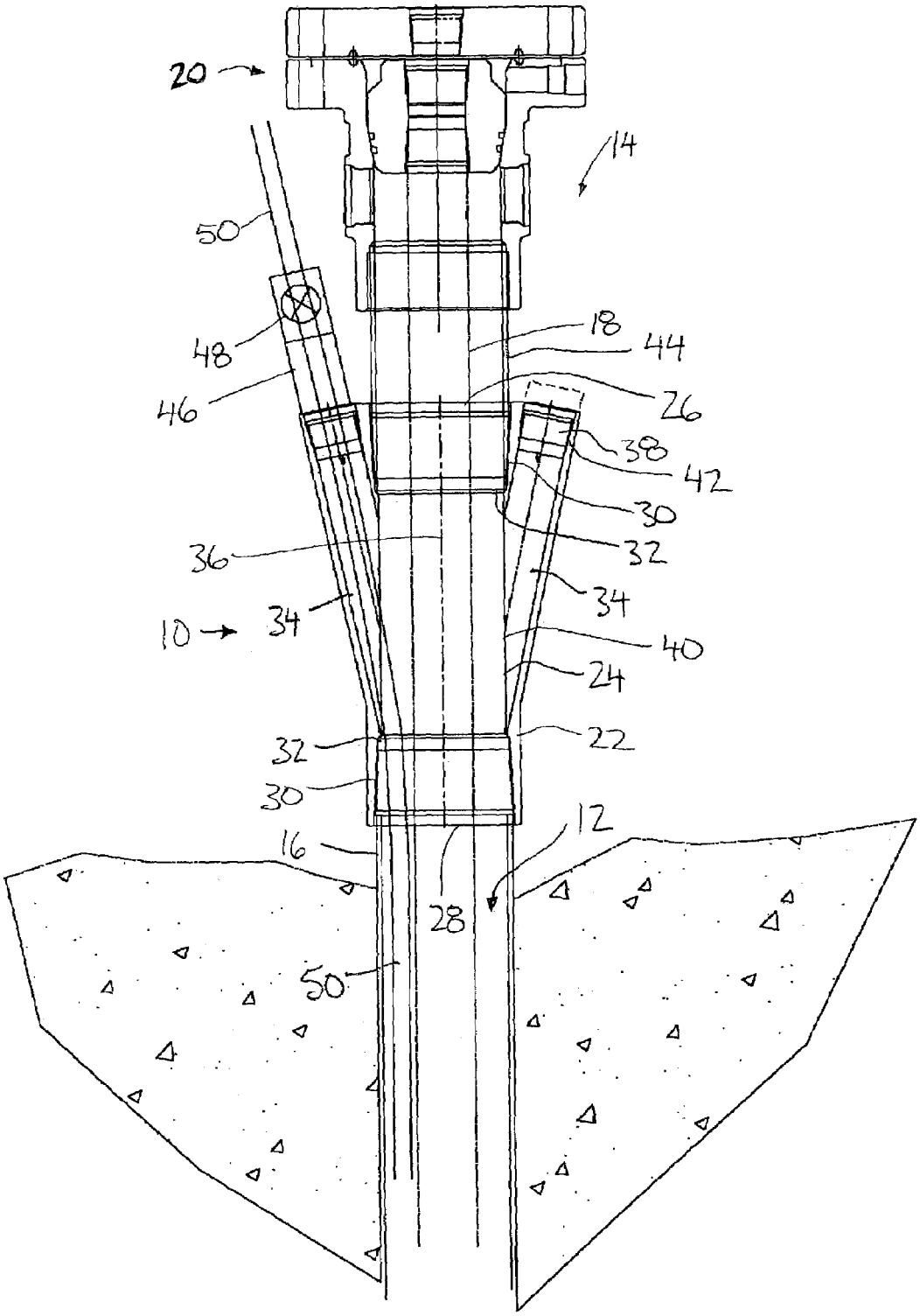
FIG. 3 is a partly sectional side elevational view of the manifold device shown connected in series between the outer casing and wellhead of an existing well.

Referring to the accompanying drawings, there is illustrated a manifold device generally indicated by reference numeral 10. The device 10 is particularly useful for providing access to the casing annulus 12 of an existing well 14 which includes an outer casing 16 and a tubing string 18 received within the outer casing to define the casing annulus 12 as a radial spacing located between the tubing string and the outer casing. The tubing string 18 is suspended within the outer casing by a wellhead 20 which caps the outer casing 16 and provides a hanger for the tubing string.

The device 10 includes an elongate tubular body 22 which includes a cylindrical bore 24 extending therethrough in the longitudinal direction between a top end 26 and a bottom end 28 of the body. The cylindrical bore defines a hollow interior of the body which spans in the longitudinal direction of the body between respective openings in the top and bottom ends. The interior diameter of the bore 24 is approximately equal to the interior diameter of the outer casing 16 and wellhead equipment supported thereon.

A counter bore 30 is provided at each end of the bore 24 so as to be located at respective top and bottom ends 26 and 28 of the tubular body. Each counter bore 30 has an interior diameter which is slightly greater than the bore 24 so as to define a shoulder 32 which faces outwardly from the tubular body in the longitudinal direction thereof. An interior surface of each counter bore 30 is internally threaded for connection to the components of the existing well. The outer diameter of the body 22 is considerably greater at the top end 26 for locating a plurality of access passages 34 therein.

Four access passages 34 are provided at even circumferential spacing about the opening in the top end so as to provide two pairs of passages which are diametrically opposed from one another. Each passage communicates with the hollow interior of the tubular body by extending generally in the longitudinal direction of the body at a downward and inward incline relative to a longitudinal axis 36 of the bore from an external end 38 at the top end of the body to an internal end 40 converging with the interior of the body adjacent the bottom end 28.

Each passage comprises a bore having a longitudinal axis lying at an incline of less then 15 degrees from the longitudinal axis of the bore 24 extending through the tubular body. The external end 38 terminates at an opening lying perpendicularly to the respective axis of the bore defining the passage 34 at a position spaced radially from the opening of the bore 24 in the top end 26 of the body. Each external end is provided with an internally threaded counter bore 42 for receiving a threaded plug to seal the opening at the external end of the passage if desired. The internal end 40 comprises an opening surrounded by a peripheral edge which is flush with the internal cylindrical surface to the bore 24 of the tubular body such that the bore 24 is free from any projections or obstructions projecting into the interior of the body.

In order to install the manifold device, the existing wellhead and related equipment is removed from the outer casing of the well. The bottom end 28 of the tubular body of the manifold device is then installed on the outer casing by receiving the outer casing within the counter bore 30. Suitable connection with the outer casing may be achieved by either threadably securing the manifold device on to the outer casing or by simply welding the manifold onto the casing depending upon the configuration of the existing outer casing equipment.

A transitional casing 44 is then installed in the counter bore 30 at the top end 26 of the manifold device either by threaded securement or welding. The transitional casing 44 is similarly configured at an upper end thereof to the existing outer casing of the well to permit the existing wellhead equipment to be readily installed thereon. The wellhead equipment may include a casing bowl and seat for a tubing hangar so that the tubing string 18 may be suspended therefrom to extend through the hollow interior of the manifold device.

A plug is located in the external end of each passage so that the well may then be operated in a normal manner. In order to access the casing annulus, an appropriate one of the plugs in a respective one of the passages 34 is removed such that a feed tube 46 may be threadably connected to the counter bore 42 in the passage. The feed tube 46 mounts a control valve 48 therein to provide selected access therethrough by various configurations of servicing tools 50 or other types of measurement devices to be used in wells.

A method of access to the well casing annulus is thus provided which allows remedial equipment to be placed into the well without displacing the production string. As noted herein the method of accessing the annulus of a well is provided by a manifold device having a central passage and which can be connected to the well casing by having a through bore located in the central tubular body having the same dimensions as the casing below and the wellhead equipment thereabove. At least one angular access passage converges into the well annulus near the bottom end of the through bore in the tubular body. The access passages are located on the exterior of the body at the top end surrounding the through bore in the body so as to be positioned to allow access without interfering with the wellhead equipment above. The external ends of the passages are located to be radially spaced from the opening in the top end of the tubular body.

In use the manifold device is attached to the well casing between the casing terminus and the wellhead equipment being a casing bowl or tubing head which is used to support the production tubing string centrally within the well. With the wellhead in place and secure, access to the well annulus may be achieved through the radially positioned access passages of the manifold device. This arrangement is particularly useful in gas and oil wells to provide an angular entry at the manifold device for the injection of specialty tools and measuring devices that may be required to service, clean, record and give access to the well for whatever operation shall be deemed necessary by the owner of the well. By injecting coil tubing into the annulus of the casing while the production tubing is in position, one may clean, stimulate or agitate a substance build up by fluid injection. Also measuring devices may be required to record or measure the activity in the annulus of the casing and accordingly this would be readily permitted by the manifold device disclosed herein.

While one embodiment of the present invention has been described in the foregoing, it is to be understood that other embodiments are possible within the scope of the invention. The invention is to be considered limited solely by the scope of the appended claims.

What is claimed is:

1. In a well having an outer casing, a wellhead supported on the outer casing and a production tubing string suspended within the outer casing from a hanger of the wellhead a manifold device comprising:

a tubular body having a hollow interior extending in a longitudinal direction of the body between first and second open ends of the body which receives the tubing string through the first and second open ends;

at least one access passage formed in the tubular body, said access passage extending generally in the longitudinal direction of the body between an external end of said access passage which is spaced radially from the hollow interior of the tubular body and an internal end of said access passage converging in communication with the hollow interior; and mounts at the respective first and second open ends of the body for mounting the body in series with the outer casing below the hanger and the wellhead of the well.

2. The device according to claim 1 wherein the hollow interior comprises a cylindrical bore having an inner diameter which is approximately equal to an inner diameter of the outer casing.

3. The device according to claim 1 wherein there is provided a transitional casing connected between the tubular body and the wellhead below the hanger.

4. The device according to claim 1 wherein the hollow interior of the body comprises a cylindrical bore extending through the body and wherein the mounts each comprise an internally threaded counter bore terminating at an internal shoulder formed in the bore extending through the tubular body.

5. The device according to claim 1 wherein both mounts comprise threaded connectors.

6. The device according to claim 1 wherein said at least one access passage extends at an inclination of less than fifteen degrees from the longitudinal direction of the body.

7. The device according to claim 1 wherein the internal end of said at least one access passage lies flush with an interior surface of the hollow interior of the tubular body.

8. The device according to claim 1 wherein there is provided a plurality of access passages evenly spaced circumferentially about the tubular body.

9. The device according to claim 1 wherein the hollow interior comprises a cylindrical bore extending through the tubular body which has a constant interior diameter.

10. A method of providing access to a casing annulus of a well having an outer casing, a wellhead for being supported on the outer casing which includes a hanger and a production tubing string for being suspended from the hanger of the wellhead within the outer casing to define the casing annulus between the outer casing and the tubing string, the method comprising:

providing a manifold device including a tubular body having a hollow interior extending in a longitudinal direction of the body between first and second open ends of the body;

providing at least one access passage formed in the tubular, body to extend generally in the longitudinal direction of the body between an external end of said access passage which is spaced radially from the hollow interior of the tubular body and an internal end of said access passage converging in communication with the hollow interior;

mounting the manifold device in series with the outer casing below the hanger and the wellhead of the well with the tubing string being received through the hollow interior of the body of the device.

11. The method according to claim 10 including orienting said at least one access passage to extend radially inwardly and downwardly from the external end to the internal end thereof.

12. The method according to claim 10 including forming the hollow interior of the tubular body with a cylindrical bore having an internal diameter which is approximately equal to the internal diameter of the outer casing.

13. The method according to claim 10 including connecting a transitional casing between the manifold device and the wellhead so as to mount the manifold device in series with the outer casing and the transitional casing spaced below the hanger and the wellhead by the transitional casing.

14. The method according to claim 10 wherein the hollow interior of the tubular body is formed by a bore extending through the tubular body including a counter bore formed in at least one end of the bore which terminates at an internal shoulder, the method including receiving the outer casing in the counter bore at a bottom end of the tubular body.

15. The method according to claim 10 including threadably securing the manifold device at both ends in series with the outer casing and the wellhead.

16. The method according to claim 10 including orienting said at least one access passage to extend at an inclination of less than fifteen degrees from the longitudinal direction of the tubular body.

17. The method according to claim 10 wherein the internal end of said at least one access passage lies flush with interior cylindrical walls of the hollow interior of the tubular body.

18. The method according to claim 10 wherein there is provided a plurality of access passages formed in the tubular body at evenly circumferentially spaced positions.

19. A manifold device in combination with a well comprising an outer casing, a wellhead, including a hanger, supported on the outer casing and a production tubing string suspended within the outer casing from the hanger of the wellhead, the manifold device comprising:

a tubular body having a hollow interior extending in a longitudinal direction of the body between first and second open ends of the body which receives the tubing string through the first and second open ends;

at least one access passage formed in the tubular body, said access passage extending generally in the longitudinal direction of the body between an external end of said access passage which is spaced radially from the hollow interior of the tubular body and an internal end of said access passage converging in communication with the hollow interior; and mounts at the respective first and second open ends of the body for mounting the body in series with the outer casing below the hanger and the wellhead of the well.

20. In a well having an outer casing, a wellhead supported on the outer casing and a production tubing string suspended within the outer casing from a hanger of the wellhead, a manifold device consisting of:

a tubular body having a hollow interior extending in a longitudinal direction of the body between first and second open ends of the body for receiving the tubing string therethrough;

at least one access passage formed in the tubular body, said access passage extending generally in the longitudinal direction of the body between an external end of said access passage which is spaced radially from the hallow interior of the tubular body and an internal end of said access passage converging in communication with the hollow interior; and mounts at the respective first and second open ends of the body for mounting the body in series with the outer casing below the hanger and the wellhead of the well.

* * * * *